US006558213B1

(12) United States Patent
McGowan

(10) Patent No.: US 6,558,213 B1
(45) Date of Patent: May 6, 2003

(54) HIGH PERFORMANCE ENGINE SKEG

(75) Inventor: Philip James McGowan, Grayslake, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/313,779

(22) Filed: May 17, 1999

(51) Int. Cl.[7] ..... B63H 20/32
(52) U.S. Cl. ..... 440/76; 440/66
(58) Field of Search ..... 114/152, 126, 114/274–282, 162–164; 440/49, 51, 66, 76, 78, 900; D15/4

(56) References Cited

U.S. PATENT DOCUMENTS

| | | | | | |
|---|---|---|---|---|---|
| 1,549,564 | A | * | 8/1925 | Slocum | 440/66 |
| D114,597 | S | * | 5/1939 | Morgan | D15/4 |
| 2,429,774 | A | * | 10/1947 | Schultz et al. | 310/66 |
| 2,847,967 | A | * | 8/1958 | Kiekhaefer | 440/78 |
| D260,395 | S | * | 8/1981 | Kappas | D15/4 |
| 4,304,557 | A | * | 12/1981 | Henrich | 440/66 |
| 4,529,387 | A | * | 7/1985 | Brandt | 440/66 |
| 4,810,218 | A | * | 3/1989 | Iwai | 440/66 |
| 5,277,634 | A | * | 1/1994 | Calamia et al. | 440/78 |
| 5,344,349 | A | | 9/1994 | Meisenburg et al. | |
| D387,775 | S | * | 12/1997 | Iekura | D15/4 |
| 5,772,481 | A | * | 6/1998 | Alexander, Jr. et al. | 440/66 |
| 5,967,866 | A | * | 10/1999 | Willows et al. | 440/76 |
| D423,017 | S | * | 4/2000 | McGowan | D15/4 |

FOREIGN PATENT DOCUMENTS

| | | | | |
|---|---|---|---|---|
| BE | 648072 | * | 9/1964 | 440/66 |
| JP | 2-20494 | * | 1/1990 | 440/78 |
| JP | 05-345593 | * | 12/1993 | 440/66 |

OTHER PUBLICATIONS

Abbott et al. Theory of wing sections, Dover, entire document, Jan. 1959.*

Land & Sea Inc. Outboard Performance Accessories 1996 Catalog; Copyright 1995; cover page; pp. 3,4, and 28; and back page.

Definition of the term "Airfoil", Dictionary of Technical Terms for Aerospace Use, Published by the US National Aeronautics and Space Administration, 1965.*

* cited by examiner

*Primary Examiner*—S. Joseph Morano
*Assistant Examiner*—Ajay Vasudeva
(74) *Attorney, Agent, or Firm*—Ziolkowski Patent Solutions Group, LLC

(57) ABSTRACT

The present invention, in one form, is a skeg having an airfoil shape which facilitates maintaining engine control even at high speed but does not adversely affect engine performance. In one embodiment, the skeg includes a fore end, an aft end, and opposing sidewalls extending from the fore end and the aft end. One sidewall includes a camber, or curved surface, and the outer surface of the other sidewall is flat, or planar.

28 Claims, 2 Drawing Sheets

HIGH PERFORMANCE ENGINE SKEG

BACKGROUND OF THE INVENTION

The invention relates generally to lower units of marine propulsion outboard engines, and more particularly, to skegs for such lower units.

High performance outboard engines, such as the 225 horsepower V6 Evinrude® outboard engine commercially available from Outboard Marine Corporation, Waukegan, Ill., can be utilized in combination with boats capable of traveling at speeds in excess of about 85 m.p.h. Maintaining engine power and control at such high speeds is important for both performance and safety.

To achieve such high speeds, the engine is mounted to the boat so that only a small portion of the engine actually travels in the water. Particularly, only a portion of the engine propeller and lower unit remain in the water at high speeds. A lowermost section of the engine lower unit typically is referred to as a skeg. The skeg extends downwardly from a gear case, and at high speeds, normally all of the skeg remains in the water.

At high speeds, significant torque can be imposed on the engine due to rotation of the propeller, and such torque can adversely affect the steerability of the engine. It would be desirable, of course, to provide a skeg configuration which reduces such torque on of the engine, particularly, at high speeds.

In addition, and at high speeds with some known gear case configurations, blow-out may occur. Blow-out refers to a condition in which cavitation, or a bubble, forms in the water around the bullet and skeg. Specifically, the engine exhaust gases and surface ventilation, at high speeds, cause the bubble to form in the water at the bullet and skeg. When blow-out occurs, engine control and performance are severely affected since the skeg and propeller are engulfed in an air pocket.

Known skeg structures for counteracting steering torque adversely affect engine performance. For example, one known structure includes a separate fin that attaches to one side of the skeg at the skeg aft end. Other known structures include a fin also located at one side of the skeg aft end, but cast integral with the skeg. While such fins may enhance directional control of the engine at high speed, such fins adversely affect engine performance. Particularly, the fins create a drag which results in lower speeds. In addition, the fins are thin and susceptible to being chipped or broken.

Until now, enhancing high speed engine control has been a trade-off to achieving higher speeds. For example, with known skegs including fins, a boat speed penalty occurs. It would be desirable to provide a skeg configuration which not only enhances control at high speeds, but also does not adversely affect engine performance to enable boat speeds of 85 m.p.h. and greater.

BRIEF SUMMARY OF THE INVENTION

These and other objects may be attained by an airfoil shaped skeg which facilitates maintaining engine control even at high speed but does not adversely affect engine performance. In one embodiment, the skeg includes a fore end, an aft end, and opposing sidewalls extend from the fore and aft ends. One sidewall includes a camber, or curved surface. The camber extends from the fore end to the aft end of the skeg. The other sidewall is relatively flat as compared to the cambered sidewall.

In operation, and due to the airfoil shape of the skeg, the skeg does not create any significant extra drag. In addition, the cambered airfoil shape of the skeg counteracts the steering torque generated by rotation of the propeller and enhances the steerability, or control, of the engine.

The above described skeg provide numerous advantages over known high performance skegs in that the present skeg enhances engine control at high speeds yet does not cause any significant speed loss. As explained above, known high performance skegs result in a trade-off between control and performance. In addition, the present skeg is sturdy.

DETAILED DESCRIPTION OF THE INVENTION

The present skeg configuration is illustrated and described below in the context of a high performance outboard engine. While the skeg configuration is believed to provide significant benefits for such engines, the skeg configuration is not limited to use in such high performance outboard engines. For example, the skeg could be used in connection with more common outboard engines as well as with stern drive units. Therefore, it should be understood that the skeg configuration is not limited to practice with just high performance outboard engines.

Figure 1:
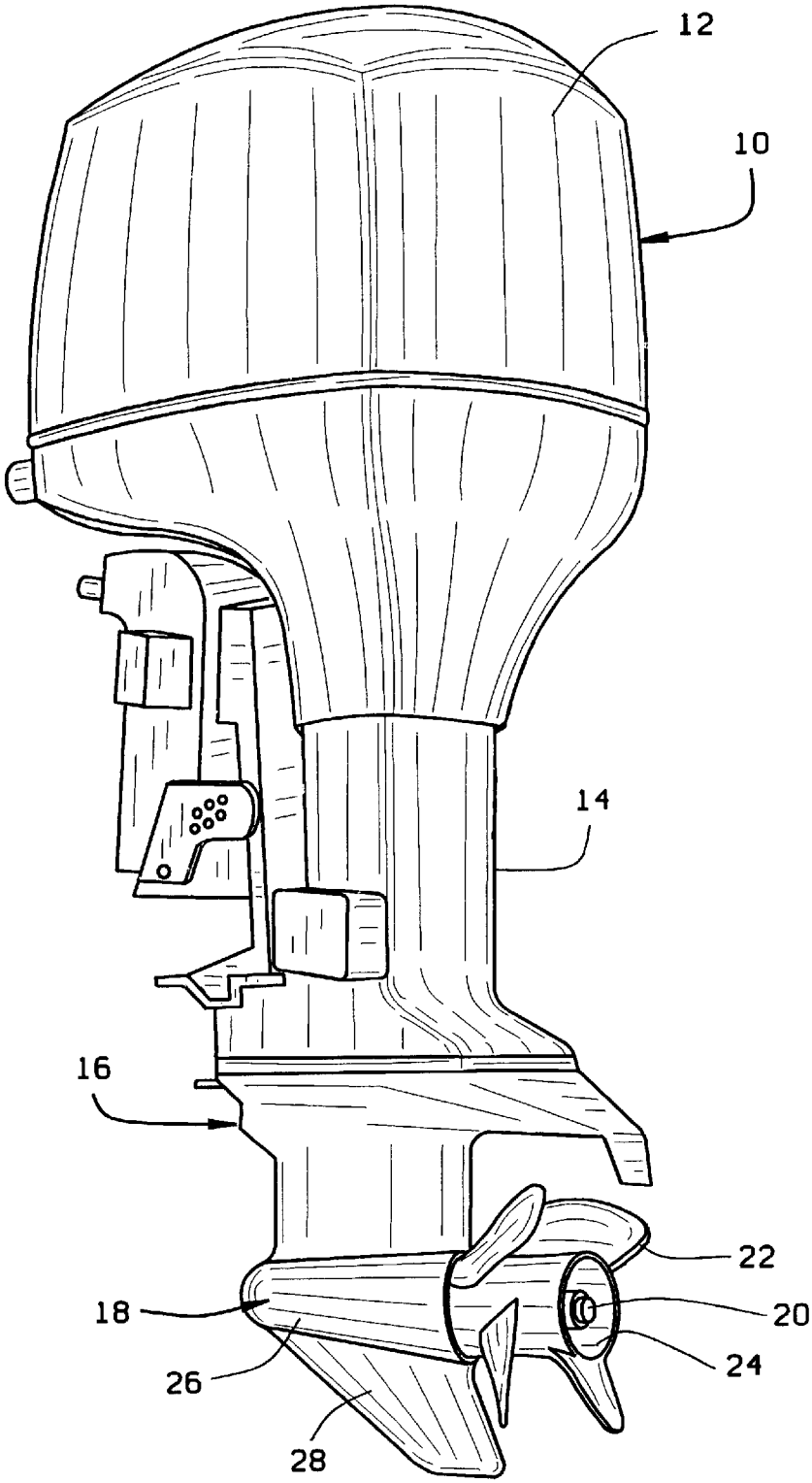
FIG. 1 is a perspective view of a high performance engine.

Referring now particularly to the drawings, FIG. 1 is a perspective view of an outboard engine, such as a high performance 225 horsepower V6 Evinrude® outboard engine commercially available from Outboard Marine Corporation, Waukegan, Ill. Engine 10 includes a cover 12 which houses a power head (not shown), an exhaust housing 14, and a lower unit 16. Lower unit 16 includes a gear case 18 which supports a propeller shaft 20. A propellor 22 is engaged to shaft 20. Propeller 22 includes an outer hub 24 through which exhaust gas is discharged.

Gear case 18 includes a bullet, or torpedo, 26 and a skeg 28 which extends vertically downwardly from torpedo 26. Further details regarding torpedo 26 configurations are set forth in U.S. Pat. No. 5,277,634, which is assigned to the present assignee. As described below in more detail, skeg 28 has an airfoil shape which facilitates control of engine 10 at high speeds, yet does not adversely affect engine performance so that boat speeds of 85 m.p.h. and greater can be achieved.

Figure 2:
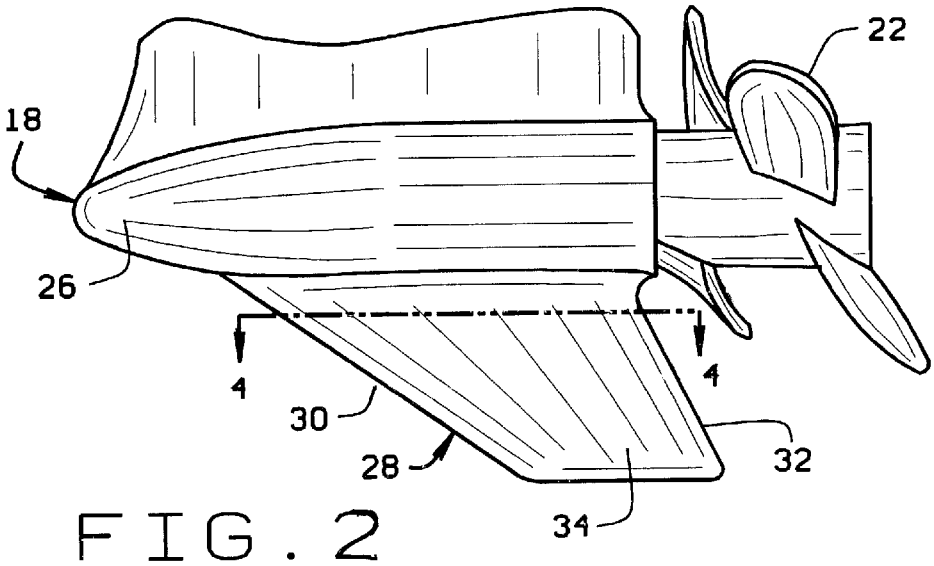
FIG. 2 is a side view of a portion of the engine gear case shown in FIG. 1.
Figure 3:
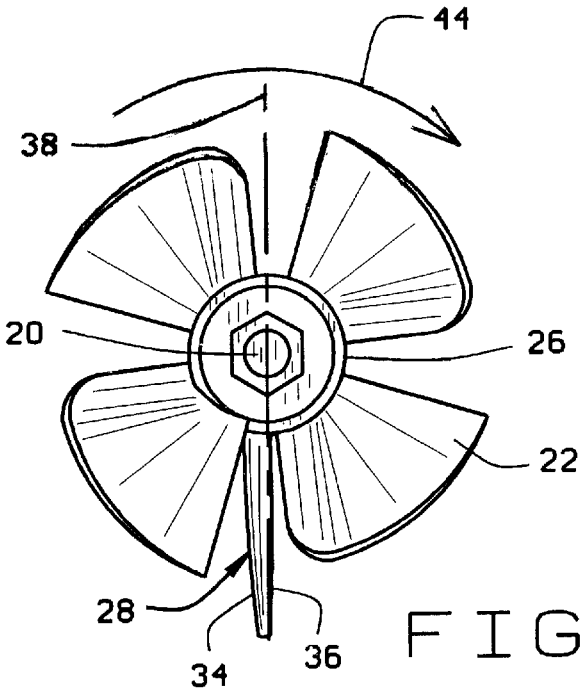
FIG. 3 is a rear view of the portion of the gear case shown in FIG. 2.
Figure 4:
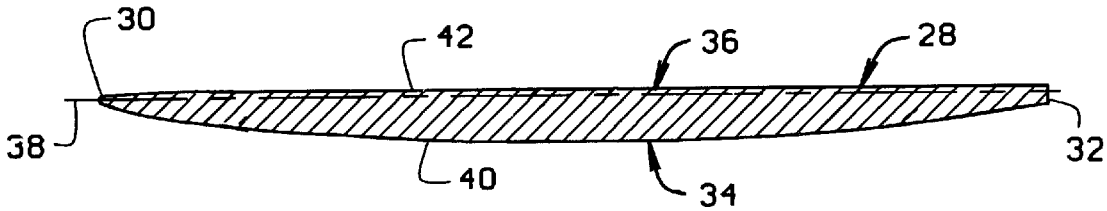
FIG. 4 is a cross sectional view of the skeg through line 4—4 in FIG. 2.

FIG. 2 is a side view of a portion of gear case 18, and FIG. 3 is a rear view of the portion of gear case 18 shown in FIG. 2. FIG. 4 is a cross sectional view of skeg 28 through line 4—4 in FIG. 2. Referring to FIGS. 2, 3 and 4, skeg 28 includes a fore, or forward end 30, and an aft, or rearward end 32. Sidewalls 34 and 36 extend from fore and aft ends 30 and 32. Fore end 30 is rounded to facilitate the flow of water.

With respect to a longitudinal axis 38 extending through a center of torpedo 26 and generally parallel with the center longitudinal axis of the engine exhaust housing, skeg 28 is not symmetrical. Skeg 28 also is not symmetrical with respect to a plane extending through a rotational axis of propeller shaft 20 and generally parallel with a center longitudinal axis of the engine exhaust housing. Particularly, sidewall 34 includes a camber, or curved, surface 40. An outer surface 42 of sidewall 36 is relatively flat, or planar, as compared to outer surface 40 of sidewall 34.

The particular curvature of outer sidewall surface 40 can be selected based on many different factors including the desired speed and aspect ratio. One particular airfoil shape which has been found acceptable for skeg 28 is known as a 16 series airfoil with a lift coefficient of 0.3, as defined in "Theory of Wing Sections", Abott and Von Doenhoff, Dover Publications, Inc., New York, 1959. Skeg 28 may be cast from aluminum using well known aluminum casting techniques.

In operation, and particularly at high speeds, only a portion of propeller 22 and bullet 26 are located in the water. Propeller 22 rotates in a clockwise direction as indicated by arrow 44 when engaged in forward gear. As the boat speed increases, i.e., propeller torque increases, lower unit 16 lifts even further from the water. Due to the airfoil shape of skeg 28, skeg 28 does not create any significant drag. Skeg 28 also remains sufficiently in the water so that engine control is maintained, even at speeds of 85 m.p.h. and greater.

Skeg 28 provides numerous advantages over known high performance skegs in that skeg 28 counteracts steering torque generated due to propeller rotation, enhances engine control at high speeds, and does not cause any significant speed loss. In addition, skeg 28 is sturdy.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A gear case for a lower unit of an engine, said gear case comprising a vertically depending skeg having an airfoil shape and comprising side surfaces, one of said side surfaces being substantially flat relative to the other of the side surfaces, thereby reducing drag during high speed operation of the engine.

2. A gear case in accordance with claim 1 wherein said skeg comprises a fore end and an aft end, opposing side surfaces extending from said fore end and said aft end, one of said side surfaces comprising a camber.

3. A gear case in accordance with claim 1 wherein said airfoil shape corresponds to a 16 series airfoil having a lift coefficient of 0.3.

4. A gear case in accordance with claim 1 wherein the lower unit further comprises a torpedo, said skeg depending vertically downwardly from said torpedo.

5. A gear case for being secured to an exhaust housing, said gear case comprising a torpedo and a skeg depending vertically downwardly from said torpedo, said skeg comprising a fore end and an aft end, said skeg being unsymmetrical from about said fore end to said aft end with respect to a longitudinal axis extending through a center of said torpedo and generally parallel with the center longitudinal axis of the engine exhaust housing, said skeg comprising side walls, one of said side walls extending substantially parallel to said longitudinal axis and the other of said side walls having a relatively more convex camber to reduce drag experienced by the skeg during high speed operation.

6. A gear case in accordance with claim 5 wherein said skeg comprises opposing sidewalls extending from said fore end and said aft end, one of said side walls comprising a camber.

7. A gear case comprising a lower unit having a propeller extending therefrom and a skeg extending vertically downwardly from the lower unit and having a fore end, an aft end, and opposing first and second side walls extending from said fore end to said aft end, said first side wall comprising a substantially flat surface, relative to said second side wall, extending from said fore end to said aft end, to counteract a steering torque experienced by said skeg during high speed operation in water.

8. A gear case in accordance with claim 7 wherein said skeg has a shape corresponding to a 16 series airfoil having a lift coefficient of 0.3.

9. An outboard engine comprising a power head, an exhaust housing, a lower unit, and a one-piece skeg extending from the lower unit, the one-piece skeg having an unsymmetrical airfoil shape having a flat surface and an opposing cambered surface configured to reduce drag in high speed engine operation.

10. An outboard engine in accordance with claim 9 wherein the lower unit further comprising a gear case, said gear case comprising a torpedo, said skeg depending vertically downwardly from said torpedo.

11. An outboard engine in accordance with claim 9 wherein said skeg comprises a fore end and an aft end, opposing sidewalls extending from said fore end and said aft end, one of said side walls comprising a camber.

12. An outboard engine in accordance with claim 11 wherein said airfoil shape corresponds to a 16 series airfoil having a lift coefficient of 0.3.

13. An outboard engine in accordance with claim 9 further comprising a gear case and an exhaust housing, said gear case secured to said exhaust housing, said gear case comprising a propeller shaft, said skeg extending vertically downward relative to said shaft.

14. An outboard engine in accordance with claim 13 wherein said skeg comprises a fore end and an aft end, and said skeg is unsymmetrical from about said fore end to said aft end with respect to a plane extending through a rotational axis of said propeller shaft and generally parallel with a center longitudinal axis of said engine exhaust housing.

15. An outboard engine in accordance with claim 14 wherein said skeg further comprises opposing sidewalls extending from said fore end and said aft end, one of said side walls comprising a camber.

16. An outboard engine in accordance with claim 13 wherein said gear case further comprises a torpedo, said skeg depending vertically downwardly from said torpedo.

17. A gear case comprising a torpedo and a skeg depending vertically downwardly from said torpedo, said skeg having a fore end, and an aft end, and an airfoil shape with a flat surface and a cambered surface extending from said fore end to said aft end, thereby reducing drag during high speed operation in water.

18. A gear case in accordance with claim 17 wherein said skeg is unsymmetrical from about said fore end to said aft end with respect to a longitudinal axis extending through a center of said torpedo.

19. A gear case in accordance with claim 17 wherein said gear case is configured for an outboard engine.

20. A gear case in accordance with claim 17 wherein said gear case is configured for a stern drive unit.

21. A gear case for a lower unit of an engine, said gear case comprising a vertically depending skeg having an airfoil shape comprising a flat side surface and a cambered side surface, thereby reducing drag during high speed operation of the engine.

22. A gear case in accordance with claim 21 wherein said skeg comprises opposing side walls extending from said fore end and said aft end.

23. A gear case for a lower unit of an engine, said gear case comprising no more than one downwardly extending skeg having an airfoil shape comprising a flat side surface and a cambered side surface to reduce drag during high speed operation of the engine.

24. A gear case for being secured to an exhaust housing, said gear case comprising a torpedo and a skeg depending vertically downwardly from said torpedo, said skeg comprising a fore end and an aft end, said skeg being unsymmetrical from about said fore end to said aft end with respect to a longitudinal axis extending through a center of said torpedo and generally parallel with the center longitudinal axis of the engine exhaust housing, said skeg comprising side walls, one of said side walls extending parallel to said longitudinal axis and the other of said side walls being cambered to counteract a steering torque experienced by said skeg during a motion in water.

25. A gear case comprising a lower unit having a propeller extending therefrom, and a single one-piece skeg extending downwardly from the lower unit and having a fore end, an aft end, and opposing first and second side walls extending from said fore end to said aft end, said first side wall comprising a camber, and said second side wall comprising a generally flat surface, as compared to the first sidewall, extending from said fore end to said aft end, thereby reducing drag during high speed operation in water.

26. An outboard engine comprising a power head, an exhaust housing, a lower unit, and a vertical skeg depending from the lower unit, the skeg having an unsymmetrical airfoil shape with side surfaces, wherein one of the side surfaces is substantially flat relative to the other of said side surfaces and configured to reduce drag in high speed engine operation.

27. A gear case comprising a torpedo and a skeg depending vertically downwardly from said torpedo, said skeg having a fore end, and an aft end, and an airfoil shape with side surfaces, one of said side surfaces being substantially flat relative to the other of the side surfaces, thereby reducing drag during high speed operation in water.

28. A gear case comprising a torpedo and a skeg depending vertically downwardly from said torpedo, said skeg having a unitary construction from a fore end to an aft end and one curved surface and one substantially flat surface extending from said fore end to said aft end thereby forming an airfoil shaped skeg that is capable of reduced drag during certain operating conditions.

* * * * *